US012507768B2

(12) United States Patent
Johnston

(10) Patent No.: US 12,507,768 B2
(45) Date of Patent: Dec. 30, 2025

(54) BRACELET INCORPORATING REMOVEABLE, ATTACHABLE, AND INTERGRATEABLE BANDS

(71) Applicant: Ann B. Johnston, Cincinnati, OH (US)

(72) Inventor: Ann B. Johnston, Cincinnati, OH (US)

( * ) Notice: Subject to any disclaimer, the term of this patent is extended or adjusted under 35 U.S.C. 154(b) by 0 days.

(21) Appl. No.: 17/584,071

(22) Filed: Jan. 25, 2022

(65) Prior Publication Data

US 2022/0232932 A1 Jul. 28, 2022

Related U.S. Application Data

(60) Provisional application No. 63/141,082, filed on Jan. 25, 2021.

(51) Int. Cl.
*A44C 5/12* (2006.01)

(52) U.S. Cl.
CPC ..... *A44C 5/12* (2013.01)

(58) Field of Classification Search
CPC ..... Y10T 29/49826; Y10T 24/17; A45D 8/34; A45D 8/00; A45D 2008/002; A45D 2008/345; A45D 8/36; A44C 5/00; A44C 5/0007; A44C 5/003; A44C 5/12; A44C 9/0092; A44C 15/003; A44C 9/0084; A44C 5/0053; A44C 5/0084; A44C 9/0023; G04B 37/00; G04B 37/005; A41D 20/00; G09F 3/005; G09F 3/14
See application file for complete search history.

(56) References Cited

U.S. PATENT DOCUMENTS

| | | | | |
|---|---|---|---|---|
| 5,826,597 | A * | 10/1998 | Chou | A45D 8/36 132/273 |
| 5,913,316 | A * | 6/1999 | Chou | A45D 8/36 132/273 |
| 2009/0145454 | A1* | 6/2009 | Saponaro | A45D 8/36 132/273 |
| 2011/0146701 | A1* | 6/2011 | Chou | A45D 8/36 132/275 |
| 2012/0125360 | A1* | 5/2012 | Hill | A45D 8/36 132/275 |

* cited by examiner

*Primary Examiner* — Jack W Lavinder
(74) *Attorney, Agent, or Firm* — Wood Herron & Evans LLP

(57) ABSTRACT

A decorative bracelet is disclosed. The bracelet comprises a ring-shaped portion configured to at least partially circumscribe a body appendage. The ring-shaped portion has an outer surface and an inner surface. The inner and outer surfaces have recessed slot portions and first and second openings disposed therein. The bracelet is provided with an attachable and integratable band having a first and second end configured to be inserted into the respective first and second opening and disposed within the respective first and second secondary recessed slot portions.

14 Claims, 8 Drawing Sheets

BRACELET INCORPORATING REMOVEABLE, ATTACHABLE, AND INTERGRATEABLE BANDS

FIELD OF THE INVENTION

The present disclosure relates to decorative jewelry. Specifically, the present disclosure relates to a decorative bracelet that is provided with a removeable, attachable, and integratable band that is suitable for use as jewelry.

BACKGROUND OF THE INVENTION

Individuals have long been wearing jewelry items as a form of personal adornment and expression. A bracelet is an ornamental band or chain that can be worn around the wrist, arm, or ankle. Bracelets can take a variety of shapes. Bracelets can also be used for identification or medical purposes. Bracelets can be made of metal, leather, cloth, wood, laminated paper, chain, enamel, plastic, or composite materials, and can include jewels, gemstones, precious stones, pearls, ornaments, charms, and trinkets.

A typical wearer typically provides him or herself with a wide variety of jewelry items to provide the desired adornment. Such jewelry collections can be extensive and given the material(s) from which jewelry is often constructed, namely precious metals and gems, the amassing of such a collection can be expensive as well. Clearly, a more cost-efficient option for adorning one's body or expressing one's self is needed.

There is also a clear need for an improved jewelry device that allows a single item of jewelry to be worn in, and function in, multiple decorative forms. The present disclosure discloses a multi-decorateable jewelry device in the form of a bracelet that allows and facilitates a user to convert the overall appearance of the device without the need for specialized tools. Further, such a multi-decorateable jewelry device can be provided in a form that does not meaningfully detract from the appearance of the jewelry item and allows the jewelry item to otherwise maintain a generally conventional appearance when worn in any of the desired decorated configurations.

SUMMARY OF THE INVENTION

The present disclosure provides for a bracelet. The bracelet comprises a ring-shaped portion having a curvilinear shape, a first end, and a second end distal thereto. The ring-shaped portion is configured to at least partially circumscribe a body appendage. The ring-shaped portion has an outer surface and an inner surface. The outer surface has a recessed slot portion disposed therein and extends from a first position adjacent the first end to a second position adjacent the distal end. A first opening is disposed adjacent the first position and disposed between the first position and the first end. A second opening is disposed adjacent the second position and disposed between the second position and the distal end.

The inner surface of the ring-shaped portion has a first secondary recessed slot portion extending from a position adjacent the first opening to a position adjacent the first end and a second secondary recessed slot portion extending from a position adjacent the second opening to a position adjacent the second end disposed thereon.

The bracelet also provides a removeable, attachable, and integratable band provided with a first and second end and is configured to be disposed within the recessed slot portion of the outer surface of the ring-shaped portion. The respective first and second end of the attachable and integratable band is configured to be inserted into the respective first and second opening and disposed within the respective first and second secondary recessed slot portions.

The present disclosure further provides for a bracelet having a removeable, attachable, and integratable band. The bracelet comprises a ring-shaped portion having a first end and a second end distal thereto. The ring-shaped portion has a curvilinear shape configured to at least partially circumscribe a body appendage. The ring-shaped portion has an outer surface and an inner surface. The outer surface has a recessed slot portion disposed therein and extends from a first position adjacent the first end to a second position adjacent the distal end. A first opening is disposed adjacent the first position and is disposed between the first position and the first end. A second opening is disposed adjacent the second position and is disposed between the second position and the distal end. The inner surface of the ring-shaped portion has a first secondary recessed slot portion extending from a position adjacent the first opening to a position adjacent the first end. The inner surface of ring-shaped portion has a second secondary recessed slot portion extending from a position adjacent the second opening to a position adjacent the second end. The bracelet is also provided with first and second attachment studs each being disposed upon the respective first and second secondary recessed slot portions.

The removeable, attachable, and integratable band is provided with a first and second end, a first attachment orifice, a second attachment orifice, and is disposed within the recessed slot portion of the outer surface of the ring-shaped portion. The respective first and second end of the removeable, attachable, and integratable band is inserted into the respective first and second opening and disposed within the respective first and second secondary recessed slot portion. Each of the respective first attachment orifice and the second attachment orifice are removably attached to the respective first and second attachment studs.

DETAILED DESCRIPTION OF THE INVENTION

Figure 1:
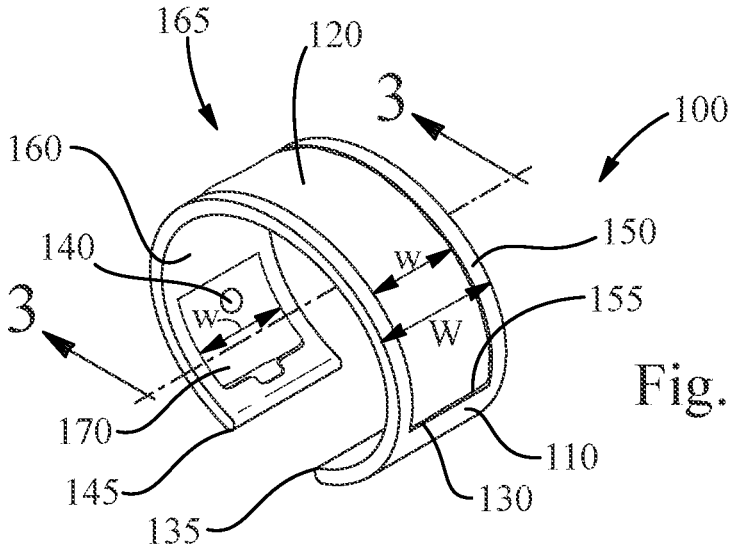
FIG. 1 is a perspective view of an exemplary bracelet configured to incorporate a removeable, attachable, and integratable band according to the present disclosure.
Figure 2:
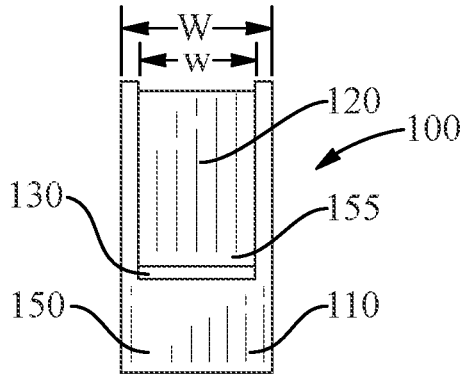
FIG. 2 is a left planar view of the exemplary bracelet configured to incorporate a removeable, attachable, and integratable band of FIG. 1.
Figure 3:
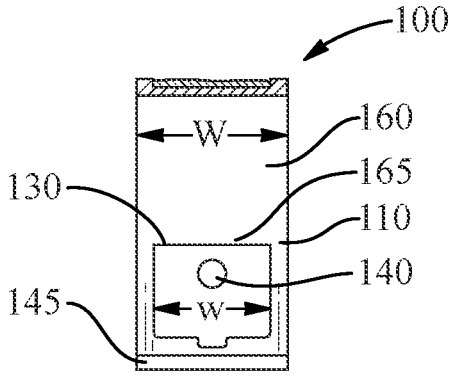
FIG. 3 is a cross-sectional view of the exemplary bracelet configured to incorporate a removeable, attachable, and integratable band taken along the line 3-3 of FIG. 1.
Figure 4:
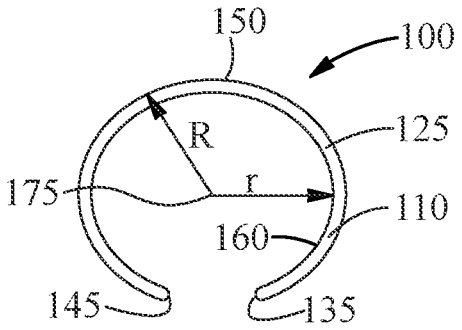
FIG. 4 is a top plan view of the exemplary bracelet configured to incorporate a removeable, attachable, and integratable band of FIG. 1.
Figure 5:
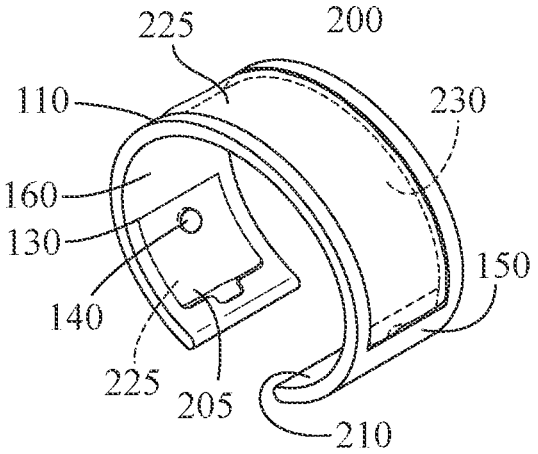
FIG. 5 is a perspective view of an exemplary bracelet incorporating a removeable, attachable, and integratable band according to the present disclosure.
Figure 6:
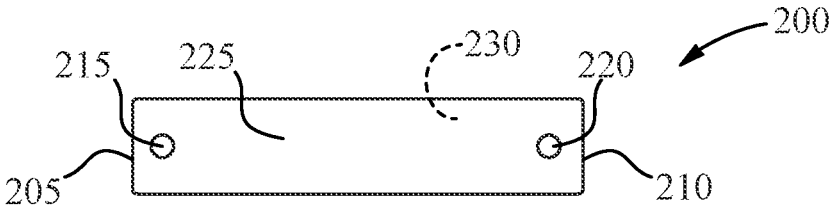
FIG. 6 is a top plan view of an exemplary removeable, attachable, and integratable band suitable for integration with the exemplary bracelet of FIGS. 1 and 5.
Figure 7:
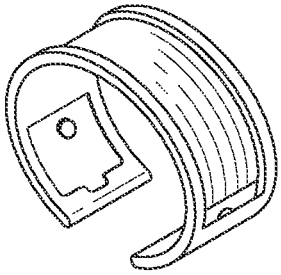
FIG. 7 is a perspective view of another exemplary bracelet configured to incorporate a removeable, attachable, and integratable band according to the present disclosure.
Figure 8:
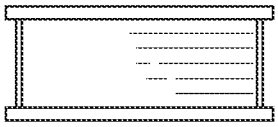
FIG. 8 is a front planar view of the exemplary bracelet configured to incorporate a removeable, attachable, and integratable band of FIG. 7.
Figure 9:
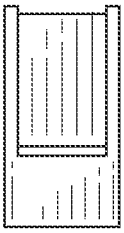
FIG. 9 is a left planar view of the exemplary bracelet configured to incorporate a removeable, attachable, and integratable band of FIG. 7, the right planar view being a mirror image thereof.
Figure 10:
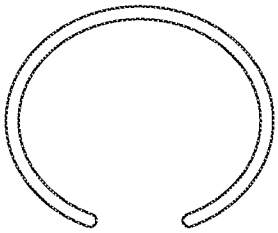
FIG. 10 is a top plan view of the exemplary bracelet configured to incorporate a removeable, attachable, and integratable band of FIG. 7 the bottom plan view being a mirror image thereof.
Figure 11:
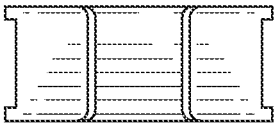
FIG. 11 is a rear planar view of the exemplary bracelet configured to a removeable, attachable, and integratable band of FIG. 7.
Figure 12:
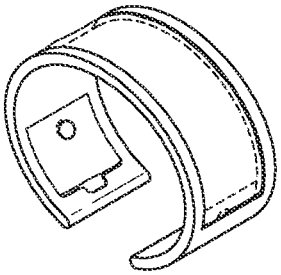
FIG. 12 is a perspective view of yet another exemplary bracelet incorporating a removeable, attachable, and integratable band according to the present disclosure.
Figure 13:
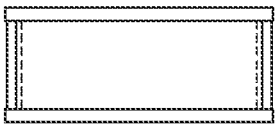
FIG. 13 is a front planar view of the exemplary bracelet incorporating a removeable, attachable, and integratable band of FIG. 12.
Figure 14:
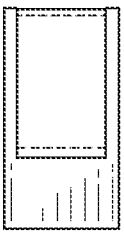
FIG. 14 is a left planar view of the exemplary bracelet incorporating a removeable, attachable, and integratable band of FIG. 12, the right planar view being a mirror image thereof.
Figure 15:
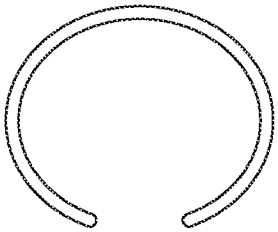
FIG. 15 is a side plan view of the exemplary bracelet incorporating a removeable, attachable, and integratable band of FIG. 12 the opposing side plan view being a mirror image thereof.
Figure 16:
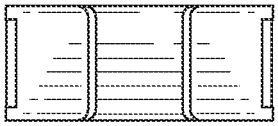
FIG. 16 is a rear planar view of the exemplary bracelet incorporating a removeable, attachable, and integratable band of FIG. 12.
Figure 17:
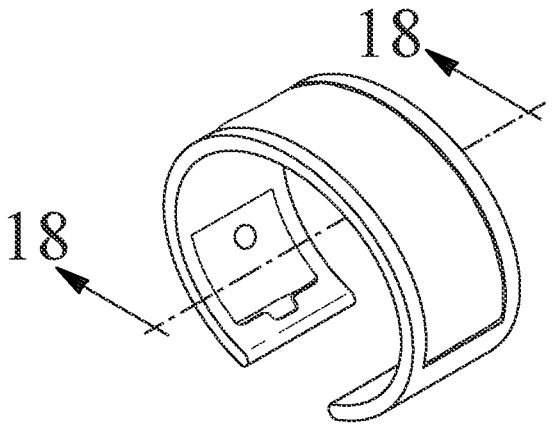
FIG. 17 is a perspective view of still yet another exemplary bracelet incorporating a removeable, attachable, and integratable band according to the present disclosure.
Figure 18:
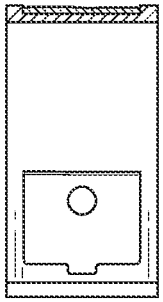
FIG. 18 is a cross-sectional view of the exemplary bracelet incorporating a removeable, attachable, and integratable band of FIG. 17 taken along the line 18-18.

With reference to FIGS. 1-6 and 17-18, an exemplary bracelet configured to incorporate an attachable and integratable band 100 (also referred to herein as bracelet 100) is shown. The bracelet 100 can be provided with a ring-shaped portion 110 having a curvilinear shape that is configured to at least partially circumscribe a body appendage such as an arm, leg, toe, finger, waist, or neck. The at least partial circumscription of the body appendage can be configured to at least partially circumscribe a body appendage such as an arm, leg, toe, finger, waist, or neck so that the bracelet 100 can be removably retained about the arm, leg, toe, finger, waist, or neck when the bracelet 100 is disposed about the body appendage until the wearer consciously decides to remove the bracelet 100 from the body appendage by the use of motive force. One of skill in the art will readily appreciate that at least partial circumscription includes the complete circumscription of the aforementioned body appendage.

The bracelet 100 may be made of or from a variety of rigid, or at least substantially rigid, uniform, or non-uniform materials. The bracelet 100 may be made from any precious or non-precious metal or alloy, stainless steel, gold, silver, sterling silver, titanium, platinum, any mineral, any precious or non-precious stone, any type of plastic, recycled material, acrylic, polymer, silicone, or similar composite, glass, enamel, clay, ceramic, wood, bamboo, bone, horn, tusk or other similar organic material, any combinations of the listed materials, or any other material or combination of materials chosen by one of ordinary skill in the art. In addition, different portions, or components, of the bracelet 100 may be made of, or from, a variety of different materials or combinations of materials. The bracelet 100 may be a provided in a variety of different colors. For example, the bracelet 100 may be provided with one or more colors or combinations of colors. The bracelet 100 may be worn around a wrist, ankle, arm, finger, waist, neck, or toe as required, or desired, by the wearer.

The bracelet 100 may include an inner dimension or radius, r, disposed between the centroid 175 (center 175) of a ring-shaped portion 110 and the inner surface 160 of ring-shaped portion 110. The bracelet 100 may include an outer dimension or radius, R, disposed between the centroid 175 (center 175) of the ring-shaped portion 110 and the outer surface 150 of ring-shaped portion 110. These dimensions, or radii, r/R, may be any dimension or measurement chosen by one of ordinary skill in the art. The dimensions, or radii, r/R, may be sized to fit a wrist, ankle, arm, finger, or toe. The distance disposed between the inner dimension, r, and the outer dimension, R, establishes the thickness 125 of the ring-shaped portion 110. The thickness 125 can vary significantly and may be any thickness chosen by one of ordinary skill in the art as well as the wearer.

The outer surface 150 of ring-shaped portion 110 can be provided with a recessed slot portion 120 disposed therein. Recessed slot portion 120 can preferably be disposed within ring-shaped portion 110 and extends from a first position 155 proximate to first end 135 to a second position 165 proximate and/or adjacent to distal end 145. Recessed slot portion 120 can be provided with a width, w, that is a fractional portion of the width, W, of ring-shaped portion 110. The width, w, of recessed slot portion 120 is provided to facilitate the overlayment (and insertion) of at least a portion of the removeable, attachable, and integratable band 200 within the confines of recessed slot portion 120. Without being bound by theory, it is believed that the insertion of at least a portion of a properly sized removeable, attachable, and integratable band 200 within the confines of recessed slot portion 120 can utilize the force of friction to maintain the properly sized removeable, attachable, and integratable band 200 within the confines of recessed slot portion 120 without the need for any additional connective engagement between the removeable, attachable, and integratable band 200 and recessed slot portion 120.

The material of ring-shaped portion 110 on the outer surface disposed between each respective edge of ring-shaped portion 110 and the respective edge of the recessed slot portion 120, forms a raised rail having a width of (W−w)/2. Each raised rail is disposed upon a respective side of ring-shaped portion 120 and of recessed slot portion 120. This rail can be provided with a decorative surface. Such a decorative surface can comprise, by way of non-limiting example, decorative protuberances, decorative wells, and the like. By way of non-limiting example, such a decorative surface disposed upon the surface of the rail that disposed between each edge of ring-shaped portion 110 and the respective starting portion of recessed slot portion 120 can be configured to have the appearance of a chain, a rope, engraving, embellishment, or any other design element as would be understood by one of skill in the art.

Additionally, the ring-shaped portion 110 of bracelet 100 also provides for openings 130. A first opening 130 is disposed proximate (also synonymous with the term "adjacent" herein) first position 155 and is disposed between first position 155 and first end 135. A second opening 130 is disposed adjacent second position 165 and is disposed between second position 165 and distal end 145. Each opening 130 is positioned upon ring-shaped portion 110 to facilitate the insertion of a respective first end 205 or second end 210 of removeable, attachable, and integratable band 200 therein and therethrough and is preferably contiguous with recessed slot portion 120. As used herein, the terms "adjacent" and "proximate" are intended to be synonymous relative terms as used herein (e.g., meaning "close to", "next to", "contacting", and the like). By way of non-limiting example, an opening 130 is positioned proximate, or adjacent to, recessed slot portion 120. Thus, opening 130 may be continuous with, or be in contacting engagement with recessed slot portion 120. Additionally, one of skill in the art will recognize that there may be a lack of contacting engagement between opening 130 and recessed slot portion 120. In any of these aforementioned described exemplary configurations, and as described herein, opening 130 is positioned proximate, or adjacent to, recessed slot portion 120.

The insertion of the first end 205 or second end 210 of removeable, attachable, and integratable band 200 into the respective opening 130 of ring-shaped portion 110 facilitates the ingress of the first end 205 or second end 210 of removeable, attachable, and integratable band 200 into contacting engagement with inner surface 160 of ring-shaped portion 110. In other words, the second surface 230 of removeable, attachable, and integratable band 200 can be provided in contacting engagement with the outer surface 150 of ring-shaped portion 110 when the second surface 230 of removeable, attachable, and integratable band 200 is inserted into recessed portion 120. Further, the respective first and second ends 205, 210 of removeable, attachable, and integratable band 200 can each inserted into a respective opening 130 thereby providing the first surface 225 of removeable, attachable, and integratable band 200 to be placed into contacting engagement with the inner surface 160 of ring-shaped portion 110.

The inner surface 160 of ring-shaped portion 110 is provided with a secondary recessed slot portion 170. Secondary recessed slot portion 170 can generally extend from a position proximate and/or adjacent to a respective opening 130 to a position proximate and/or adjacent to respective to first end 135 or distal end 145. Each secondary recessed slot portion 170 is preferably contiguous with a respective opening 130. Similar to recessed slot portion 120, the secondary recessed slot portion 170 can also be provided with a width, w, that is a fractional portion of the width, W, of ring-shaped portion 110. The width, w, of secondary recessed slot portion 170 is provided to facilitate the overlayment of at least a portion of removeable, attachable, and integratable band 200 when the first surface 225 of removeable, attachable, and integratable band 200 is removably inserted within the confines of secondary recessed slot portion 170.

Additionally, a finger notch can be provided in connecting engagement with the edge of each respective secondary recessed slot portion 170. A finger notch can provide the ability to insert a fingernail or other pry-type implement under the removeable, attachable, and integratable band 200 in order to more effectively remove the removeable, attachable, and integratable band 200 from contacting and mating engagement within the confines of each respective secondary recessed slot portion 170.

If desired, selected portions of the second surface 230 of removeable, attachable, and integratable band 200 can be provided with an attachment surface such as an adhesive coating, a plurality of rugosities, hook-and-loop fasteners, or other surface attaching structure that can facilitate the fastenable and removeable attachment to a corresponding second surface 230 of removeable, attachable, and integratable band 200 to each respective secondary recessed slot portion 170 of the inner surface 160 of ring-shaped portion 110. Such an attachment surface can obviate the need for any mechanical attachment means (e.g., buttons, snaps, etc.) in order to secure a removeable, attachable, and integratable band 200 to bracelet 100.

Each secondary recessed slot portion 170 can be provided with an attachment stud 140. Functionally, a respective attachment stud 140 is configured to be provided with a diameter and height commensurate with the diameter of first attachment orifice 215/second attachment orifice 220 of removeable, attachable, and integratable band 200 and the thickness of removeable, attachable, and integratable band 200 so that the removeable attachment of first attachment orifice 215/second attachment orifice 220 about the respective attachment stud 140 effectively secures the respective first end 205/second end 210 of removeable, attachable, and integratable band 200 to the respective outer surface 150/inner surface 160 of ring-shaped portion 110 of bracelet 100.

One of skill in the art could also provide the center-to-center distance between the respective first attachment orifice 215 and second attachment orifice 220 of removeable, attachable, and integratable band 200 with a length that is incrementally less than the center-to-center distance between the respective attachment studs 140. This would require the removeable, attachable, and integratable band 200 to stretch an amount sufficient to facilitate the circumscription of first attachment orifice 215 and second attachment orifice 220 of removeable, attachable, and integratable band 200 about the respective attachment stud 140.

Figure 19:
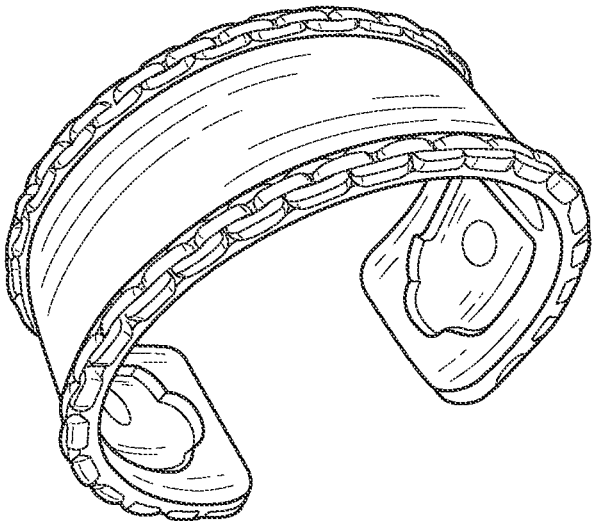
FIG. 19 is a perspective view of yet another exemplary bracelet incorporating a removeable, attachable, and integratable band according to the present disclosure having a decorative adornment on the outer surfaces of ring-shaped portion of the bracelet.
Figure 20:
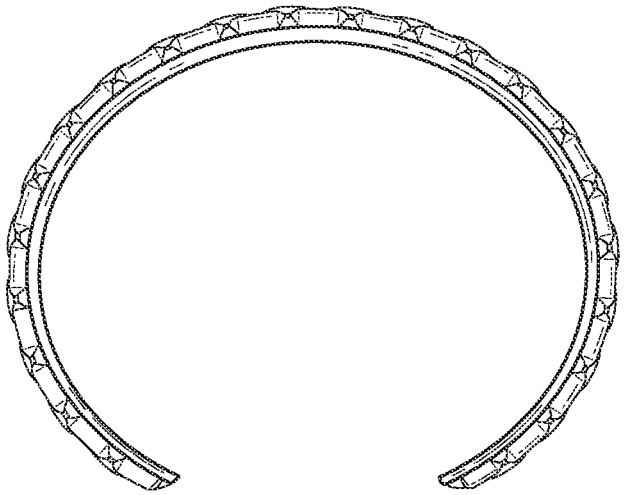
FIG. 20 is a side plan view of the exemplary bracelet incorporating a removeable, attachable, and integratable band of FIG. 19, the opposing side plan view being a mirror image thereof.
Figure 21:
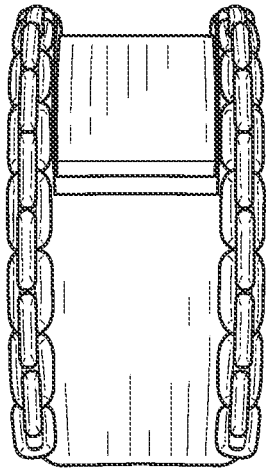
FIG. 21 is a left planar view of the exemplary bracelet incorporating a removeable, attachable, and integratable band of FIG. 19.
Figure 22:
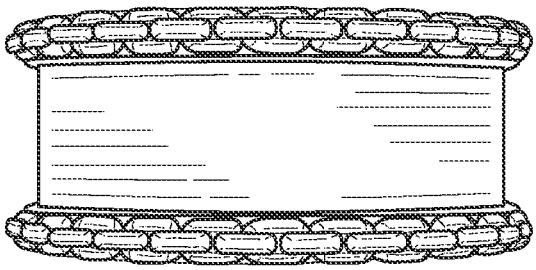
FIG. 22 is a top planar view of the exemplary bracelet incorporating a removeable, attachable, and integratable band of FIG. 19.
Figure 23:
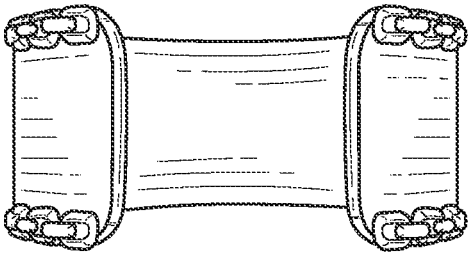
FIG. 23 is a bottom planar view of the exemplary bracelet incorporating a removable, attachable, and integratable band of FIG. 19.
Figure 24:
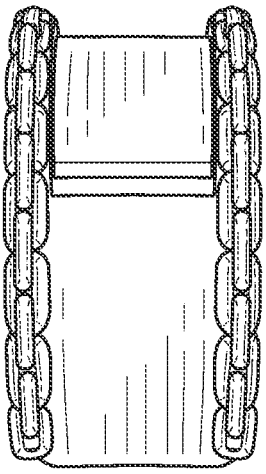
FIG. 24 is a right planar view of the exemplary bracelet incorporating a removeable, attachable, and integratable band of FIG. 19; opposing the left planar view of FIG. 21.
Figure 25:
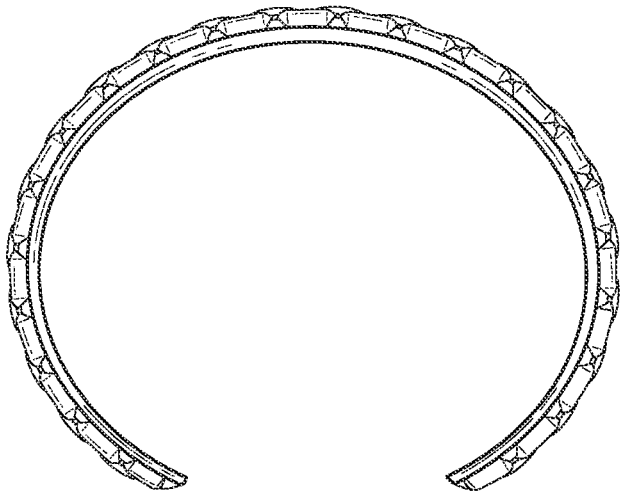
FIG. 25 is the side plan view of the exemplary bracelet incorporating a removeable, attachable, and integratable band opposing the side plan view of FIG. 20.

The portion of the outer surface 150 of ring-shaped portion 110 of bracelet 100 and oppositely disposed above, and relative to, each secondary recessed slot portion 170 can be provided with adornment(s) as desired by the wearer or a designer as would be understood by one of skill in the art. By way of non-limiting example, the referenced portion of the outer surface 150 can be provided with engravings, identification markings, other adornments, and combinations thereof as would be understood by one of skill in the art. An example of such engraved adornments is shown in FIGS. 19-25 where the outer surfaces 150 of the ring-shaped portion 110 of bracelet 100 are adorned but engraved chain adornments.

The portion of the outer surface 150 of ring-shaped portion 110 of bracelet 100 and oppositely disposed above, and relative to, each secondary recessed slot portion 170 can also be provided with other adornments. Various non-limiting other adornments can include, but not be limited to, jewels (e.g., a precious stone or any ornament of precious metal often set with stones or decorated with enamel), devices (e.g., including, but not limited to cellular phones, satellite phones, smart phones, personal digital assistants (PDA's), tablets, pagers, and other similar devices that facilitate voice and data communications), digital displays (e.g., essentially flat panel screens that rely on different technologies to present multimedia content to an audience such as LCD screens that use liquid crystal cells to display content and LED screens based on Light Emitting Diode technology), timepieces (e.g., a device (such as a clock or watch) to measure or show progress of time), safety and/or reflective materials (e.g., a retroreflector (sometimes called a cataphote device) or surface that reflects radiation (usually light) back to its source with minimum scattering), GPS devices (e.g., a satellite navigation device, colloquially called a GPS receiver, or simply a GPS, or a device that is capable of receiving information from GNSS satellites and then to calculate the device's geographical position), medical and/or health monitoring devices (e.g., a display produced by a device that takes signals and displays the signals on a screen or a computer monitor, monitor, computer, computing device, computing machine, data processor, electronic computer, information processing system (a machine for performing calculations automatically), wearable healthcare technology including electronic devices that consumers can wear, health monitoring devices, Fitbits® and smartwatches, and are designed to collect the data of users' personal health and exercise), combinations thereof, and the like.

Alternatively, by way of an alternative embodiment, an article of jewelry in the form of a pendant (i.e., a piece of jewelry that hangs from a chain worn around the neck), can incorporate relevant portions of the present disclosure. Conventionally, there are various types of jewelry pendants with a variety of shapes. Among these, a typical jewelry pendant consists of a necklace chain to be wound around the neck of the wearer and a decorative piece to which a jewel such as a diamond is mounted. Depending on a type of such a jewelry pendant, such a pendant can be provided with a surface having a planar or semi-planar geometry and be configured to be suspended from the chain through a loop ring, or both ends of the chain are directly fixed to the decorative piece. One of skill in the art will readily appreciate that at overall geometry and planeness of the pendant can provide any shape as may be required by the user or wearer.

The pendant may be made of, or from, a variety of substantially rigid uniform or non-uniform materials. The pendant may be made from any metal or alloy, stainless steel, gold, silver, titanium, platinum, any mineral, any precious or non-precious stone, any type of plastic, enamel, wood, any combinations of listed materials, or any other material or combination of materials chosen by one of ordinary skill in the art. In addition, different portions, or components, of the pendant may be made of, or from, a variety of different materials or combinations of materials. The pendant may be a provided in a variety of different colors. For example, the pendant may be one or more colors or combinations of colors. The pendant may be worn around a wrist, ankle, arm, finger, or toe as required, or desired, by the wearer.

The outer surface of the pendant can be provided with a recessed slot portion disposed therein. The recessed slot portion 10 can preferably be disposed within the pendant can extend from a first position proximate and/or adjacent to first end to a second position proximate and/or adjacent to a distal end. The recessed slot portion can be provided with a width, w, that is a fractional portion of the width, W, of the pendant. The width, w, of the recessed slot portion can be provided to facilitate the overlayment (and insertion) of at least a portion of removeable, attachable, and integratable band within the confines of the recessed slot portion.

Additionally, the pendant can also provide for openings. A first opening can be disposed adjacent the first position and is disposed between the first position and the first end of the pendant. A second opening can be disposed adjacent the second position and is disposed between the second position and the distal end of the pendant. Each opening is positioned upon the pendant to facilitate the insertion of a respective first end or second end of a removeable, attachable, and integratable band therein and therethrough.

The insertion of the first end or second end into the respective opening facilitates the ingress of the first end or second end of a removeable, attachable, and integratable band into contacting engagement with inner surface of the pendant. In other words, the second surface of the removeable, attachable, and integratable band can be provided in contacting engagement with the outer surface of the pendant when the second surface of the removeable, attachable, and integratable band is inserted into the recessed portion. Further, the respective first and second ends of the removeable, attachable, and integratable band can each inserted into a respective opening thereby providing the first surface of the removeable, attachable, and integratable band to be placed into contacting engagement with the inner surface of the pendant.

The inner surface of the pendant is provided with a secondary recessed slot portion. The secondary recessed slot portion can generally extend from a position proximate and/or adjacent to opening to a position proximate and/or adjacent to respective to first end or distal end. Similar to recessed slot portion, the secondary recessed slot portion can also be provided with a width, w, that is a fractional portion of the width, W, of the pendant. The width, w, of the secondary recessed slot portion is provided to facilitate the overlayment of at least a portion of the removeable, attachable, and integratable band when the first surface of the removeable, attachable, and integratable band is removeable inserted within the confines of the secondary recessed slot portion.

Each secondary recessed slot portion is provided with an attachment stud. Functionally, attachment stud is configured with a diameter and height commensurate with the diameter of first attachment orifice/second attachment orifice of the pendant and the thickness of removeable, attachable, and integratable band so that the removeable attachment of first attachment orifice/second attachment orifice about the respective attachment stud effectively secures the respective first end/second end of removeable, attachable, and integratable band to the respective outer surface/inner surface of the pendant.

In a preferred embodiment, attachment stud 140 is provided with a height that does not extend beyond the surface of inner surface 160. One of skill in the art will readily appreciate that if the height of attachment stud 140 extends past the surface of inner surface 160 (i.e., attachment stud 140 is unduly long), the possibility of a great deal of rubbing by attachment stud 140 on the skin of the wearer contacting bracelet 100 is likely. This skin rubbing can result in in chafing, hair loss, and eventual edema. Chafing refers to the irritation of skin caused by repetitive friction, usually generated through skin to skin contact of multiple body parts. Severe chafing is known as friction burn. Edema is an abnormal accumulation of fluid in the interstitium, located beneath the skin and in the cavities of the body, which can cause severe pain. Clinically, edema manifests as swelling. The amount of interstitial fluid is determined by the balance of fluid homeostasis; and the increased secretion of fluid into the interstitium, or the impaired removal of the fluid, can cause the condition. Therefore, one of skill in the art will readily appreciate that in an effort to ameliorate such chafing, attachment stud 140 disposed in secondary recessed portion 170 can be provided with an overall height that does not extend beyond the surface of inner surface 160.

Any dimensions and/or values disclosed herein are not to be understood as being strictly limited to the exact numerical values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A bracelet comprising:

a) a ring-shaped portion having a first end and a second end distal thereto, wherein said ring-shaped portion has a curvilinear shape, wherein said ring-shaped portion is configured to at least partially circumscribe a body appendage, and wherein said ring-shaped portion has an outer surface and an inner surface;

b) wherein said outer surface has a recessed slot portion disposed therein, said recessed slot portion extending from a first position adjacent said first end to a second position adjacent said second distal end;

c) a first opening disposed adjacent said first position and disposed between said first position and said first end;

d) a second opening disposed adjacent said second position and disposed between said second position and said second distal end;

e) said inner surface of ring-shaped portion having a first secondary recessed slot portion, said first secondary recessed slot portion extending from a position adjacent said first opening to a position adjacent said first end;

f) said inner surface of ring-shaped portion having a second secondary recessed slot portion, said second secondary recessed slot portion extending from a position adjacent said second opening to a position adjacent said second end;

g) a removeable, attachable, and integrateable band comprising a first end, a second end, a first attachment orifice disposed adjacent to the first end of the band, and a second attachment orifice disposed adjacent to the second distal end of the band and the removable, attachable, and integrateable band being stretchable and configured to be removably disposed within said recessed slot portion of said ring-shaped portion;

h) wherein each of said respective first and second end of said removable, attachable and integrateable band is configured to be inserted into said respective first and second opening and disposed within said respective first and second secondary recessed slot portions;

i) wherein a first and a second attachment stud is disposed upon said first and second secondary recessed slot portions respectively and a height of each of said first and second attachment studs does not extend beyond said inner surface of the ring-shaped portion; and j) wherein the removable, attachable, and integrateable band can stretch a sufficient amount to facilitate that the removable, attachable, and integrateable band is removably disposed within said recessed slot portion of ring-shaped portion such that said first orifice removably attaches to the first attachment stud and said second orifice removably attaches to the second attachment stud.

2. The bracelet of claim 1, wherein said ring-shaped portion is provided with a first width, (W), and said recessed slot portion is provided with a second width, (w), said second width, (w), being a fractional portion of said first width, (W).

3. The bracelet of claim 2, said second width, (w), is configured to facilitate overlayment of at least a portion of said removable, attachable, and integrateable band within said first secondary recessed slot portion.

4. The bracelet of claim 2, said second width, (w), is configured to facilitate overlayment of at least a portion of said removable, attachable, and integrateable band within said second secondary recessed slot portion.

5. The bracelet of claim 1 wherein said ring-shaped portion of said bracelet is provided with a centroid and an inner dimension, (r), said inner dimension, (r), being determined as a distance between said centroid and said inner surface of said ring-shaped portion.

6. The bracelet of claim 5 wherein, said inner dimension, (r), is configured to at least partially circumscribe a body appendage.

7. The bracelet of claim 5 wherein said ring-shaped portion has a thickness, said thickness being a distance between said inner dimension, (r), and an outer dimension, (R), said outer dimension, (R), being determined as a distance between said centroid and said outer surface of said ring-shaped portion.

8. A bracelet having a removeable, attachable, and integrateable band, said bracelet comprising:

a) a ring-shaped portion having a first end and a second end distal thereto, said ring-shaped portion having a curvilinear shape, said ring-shaped portion configured to at least partially circumscribe a body appendage, said ring-shaped portion having an outer surface and an inner surface;

b) said outer surface having a recessed slot portion disposed therein, said recessed slot portion extending from a first position adjacent said first end to a second position adjacent said second distal end;

c) a first opening disposed adjacent to said first position and disposed between said first position and said first end;

d) a second opening disposed adjacent said second position and disposed between said second position and said second distal end;

e) said inner surface of ring-shaped portion having a first secondary recessed slot portion, said first secondary recessed slot portion extending from a position adjacent said first opening to a position adjacent said first end;

f) said inner surface of ring-shaped portion having a second secondary recessed slot portion, said second secondary recessed slot portion extending from a position adjacent said second opening to a position adjacent said second end;

g) first and second attachment studs, each of said first and second attachment studs being disposed upon said first and second secondary recessed slot portions, respectively, wherein a height of each of said first and second attachment studs does not extend beyond said inner surface of the ring-shaped portion;

h) said removeable, attachable, and integrateable band comprising a first end, a second end, a first attachment orifice disposed adjacent to the first end of the band, and a second attachment orifice disposed adjacent to the second distal end of the band, wherein the removable, attachable, and integrateable band is stretchable and is removably disposed within said recessed slot portion of said ring-shaped portion, wherein said first and second end of said removable, attachable, and integrateable band is inserted into said first and second opening, respectfully and disposed within said first and second secondary recessed slot portion, respectfully; and i) wherein the removable, attachable, and integrateable band is stretchable a sufficient amount to facilitate that said removable, attachable, and integrateable band is removably disposed within said recessed slot portion of said ring-shaped portion such that said first orifice removably attaches to the first attachment stud and said second orifice removably attaches to the second attachment stud.

9. The bracelet of claim 8, wherein said ring-shaped portion is provided with a first width, (W), and said recessed slot portion is provided with a second width, (w), said second width, (w), being a fractional portion of said first width, (W).

10. The bracelet of claim 9, said second width, (w), is configured to facilitate overlayment of at least a portion of said removeable, attachable, and integrateable band within said first secondary recessed slot portion.

11. The bracelet of claim 9, said width, (w), is configured to facilitate overlayment of at least a portion of said removable, attachable, and integrateable band within said second secondary recessed slot portion.

12. The bracelet of claim 8, wherein said ring-shaped portion of said bracelet is provided with a centroid and an inner dimension, (r), said an inner dimension, (r), being determined as a distance between said centroid and said inner surface of said ring-shaped portion.

13. The bracelet of claim 12 wherein, said inner dimension, (r), is configured to at least partially circumscribe said body appendage.

14. The bracelet of claim 12 wherein said ring-shaped portion has a thickness, said thickness being a distance between said inner dimension, (r), and an outer dimension, (R), said outer dimension, (R), being determined as a distance between said centroid and said outer surface of said ring-shaped portion.

* * * * *